US008276406B2

(12) United States Patent
Soto et al.

(10) Patent No.: US 8,276,406 B2
(45) Date of Patent: Oct. 2, 2012

(54) HYDRODYNAMIC BALANCE RING FOR CENTRIFUGAL ROTATION MACHINES

(75) Inventors: Leonardo Urbiola Soto, Queretaro (MX); Alfonso Thompson Salinas, Queretaro (MX); Martin Ortega Brena, Cuernavaca Morelos (MX)

(73) Assignee: Mabe, S.A. de C.V., Queretaro (MX)

( * ) Notice: Subject to any disclaimer, the term of this patent is extended or adjusted under 35 U.S.C. 154(b) by 943 days.

(21) Appl. No.: 12/339,191

(22) Filed: Dec. 19, 2008

(65) Prior Publication Data

US 2009/0158783 A1 Jun. 25, 2009

(30) Foreign Application Priority Data

Dec. 19, 2007 (MX) ..... MX/a/2007/016516

(51) Int. Cl.
*D06F 37/24* (2006.01)

(52) U.S. Cl. ..... 68/23.2

(58) Field of Classification Search ..... 68/23.2, 68/23 A, 23 R, 23.3, 23.5; 74/573.1
See application file for complete search history.

(56) References Cited

U.S. PATENT DOCUMENTS 2,603,982 A * 7/1952 Davis et al. ..... 368/171
3,610,069 A 10/1971 Tanner
4,044,626 A 8/1977 Hayashi et al.
4,250,724 A * 2/1981 Altnau ..... 68/23.2
4,545,847 A * 10/1985 Schneller ..... 156/579
4,646,545 A * 3/1987 Fanson et al. ..... 68/23.2
5,765,404 A 6/1998 Fanson
5,782,110 A 7/1998 Kim
5,855,127 A 1/1999 Kohara et al.
5,916,274 A 6/1999 Lee
6,389,628 B1 5/2002 Sears
6,658,902 B2 12/2003 Southworth et al.
7,757,324 B2 * 7/2010 Leidig et al. ..... 8/159
7,900,305 B2 * 3/2011 Leidig et al. ..... 68/23.2
2005/0273945 A1 12/2005 Zaccone et al.

* cited by examiner

*Primary Examiner* — Joseph L Perrin

(74) *Attorney, Agent, or Firm* — Enrique J. Mora; Beusse Wolter Sanks Mora & Maire, P.A.

(57) ABSTRACT

A balance ring for washing machine devices as may be used in vertical and horizontal axis washing machines is provided. One structural arrangement of the ring comprises alternatively disposed positive and negative curved blades, as well as curved and straight blades, that in combination with the different heights of the blades, reduce the time and the amplitude of the vibrations of the transition state, thus enabling the washing basket to spin at higher velocities, and reducing the centrifugal cycle while increasing the centrifugal force applied to the objects being washed. Such an structural arrangement provides a superior drying of the clothes and further results in energy savings.

13 Claims, 15 Drawing Sheets

P
N
r
θ
$L_\theta$
L
r
31
38
16
32
30
33
$P_f$
$r_{ie}$
$r_f$
r
$r_o$
ω

HYDRODYNAMIC BALANCE RING FOR CENTRIFUGAL ROTATION MACHINES

RELATED APPLICATIONS

This application claims priority from Mexican application Serial No. MX/a/2007/016516 filed Dec. 19, 2007, which is incorporated herein by reference in its entirety.

BACKGROUND

Every washing machine user at times has experienced that the device, while operating at the centrifugal or drying cycles, can experience an extreme vibration, which can even displace the device (it makes it "walk"). This is due to the different shapes and densities of the clothing or objects that are being washed which, after the washing cycle and draining the washing basket, tend to stick together and lump at some point of said washing basket and causing and unbalance. This problem may also due to the introduction of big and heavy objects to the washing basket, such as shoes. After the washing cycle and draining of the washing liquid from the basket, the shoes settle on the bottom of said basket and create a great unbalance which generates undesired strain in the washing machine components, excessive noise, and frequent "walking". The dynamic charges created by the excessive vibration also wear-out and damage the washing machine components. Therefore, due to the aforementioned reasons and some others than someone skilled in the art may discern, the centrifugal forces created by the objects to wash inside the aforementioned washing basket must be balanced. Several solutions to this problem have been developed: the previous art shows the use of balance rings, which are hollow rings placed on the top part of the washing basket. This rings act as a counterweight to the load of clothes because inside the ring or toroid there is either some type of liquid or solid balls that adopt an antagonist position to the centrifugal forces created by the position adopted by the objects to wash, thus balancing the basket. For example the document U.S. Pat. No. 4,044,026 of Hayashi et al. describes a balance ring placed on the top of the washing basket, which is filled with liquid that is separated in chambers through a series of partitions once the drying cycle starts for the objects to be spin-washed. Having square flippers in the partitions that keep the liquid separated when the washing basket spins has the inconvenience of producing an undesired vibration during the transitory cycle of the system and does not allow higher centrifuge velocities, which are important for drying in less time. Other example of a balance ring is described in the document U.S. Pat. No. 5,782,110 of Do Weon Kim; which describes a balance ring placed over a washing basket. The balance ring has within 3 tracks of different ratios and with different track widths that house steel balls dipped in oil. The diameter of the steel balls corresponds to the track width where they are placed, thus there are 3 different steel ball diameters, ranging from the smallest to the largest towards the outside. Once the centrifugal cycle is set, the steel balls confront the unbalancing loads, thus balancing the washing basket while it is spinning. Although the inventor of the aforementioned document claims that his invention allows the washing basket to spin at high velocities, the construction of said balance ring is much too complicated and difficult to assemble, requiring many parts and a special fluid, thus resulting too expensive.

One of the objectives of the present invention is to produce a balance ring that does not employ an expensive fluid, it is easy to manufacture, reduces the vibration generated at the transitional cycle, operates at high velocities, and that can be adapted to different types of washing baskets of vertical axis washing machines preferably, but without excluding horizontal axis applications.

DETAILED DESCRIPTION OF THE INVENTION

Figure 1:
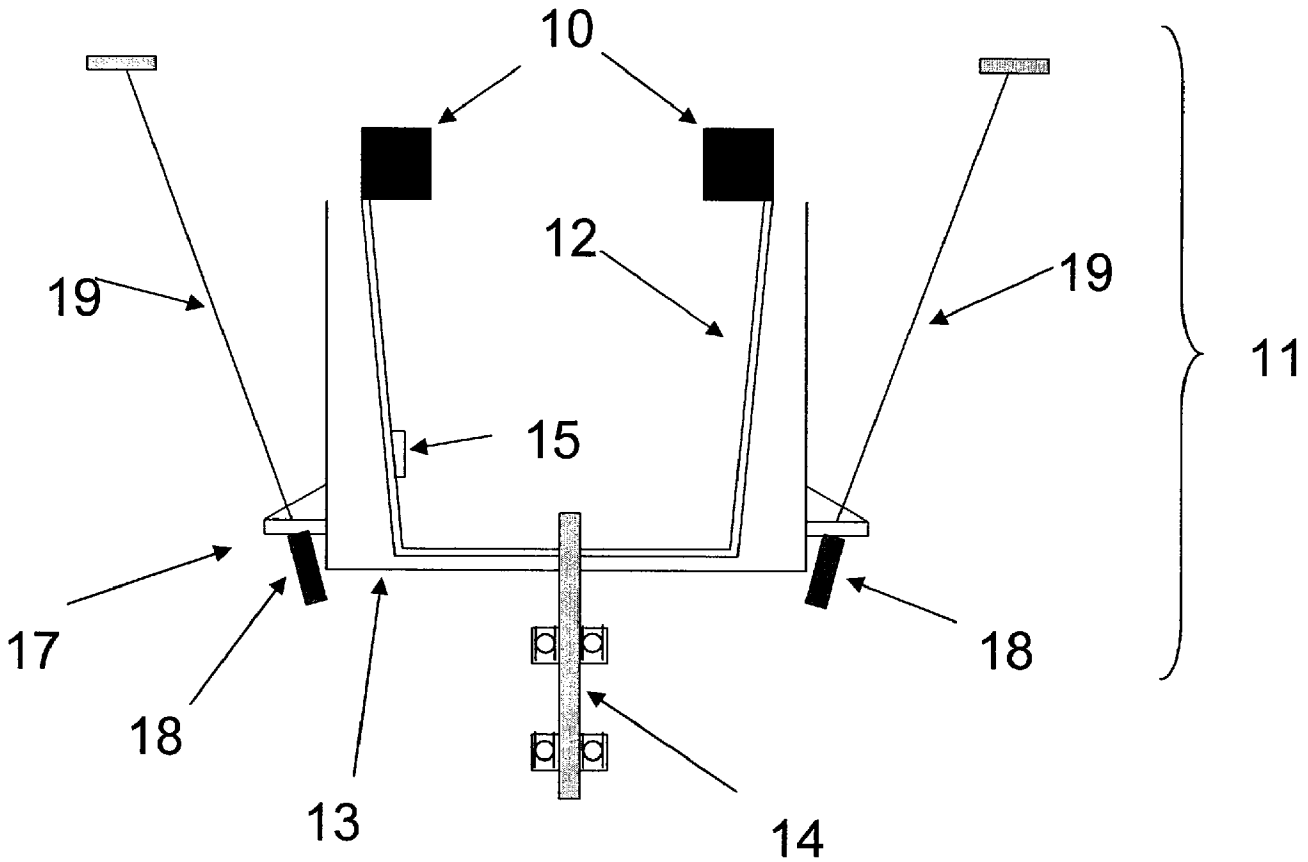
FIG. 1 Schematic view of a sub-washing machine

The proposed system in FIG. 1 represents a diagram of a sub-washing machine 17, which comprises a tub 13 that contains a washing basket 12. At the bottom the tub 13 has an opening right in its center through which a vertical rotation axis passes. Said opening allows a driveshaft 14 to pass, which is coupled to the bottom of the basket 12 in order to transmit rotational movement to said basket 12. The driveshaft 14 is propelled by a motor, which is mounted below the tub 13. In a preferred embodiment the axis of the rotor of said motor is parallel to the drive shaft 14. These components are coupled through a pulley and an endless band. In other embodiment, the motor's rotor axis may be coincident and collinear with the vertical axis of the driveshaft 14; the tub 13 is supported by a suspension 11 consisting of a set of rods 19 that in their lower part consist of a shock absorber 18 and are attached at the bottom to the tub 13 and at the top are supported by the washing machine housing (not shown). The basket 12 is capped by the balance ring 10 which acts to counteract the unbalance caused by the load 15 represented in this diagram, that is, the objects being washed which after the washing cycle do not settle uniformly on the bottom of the basket 12, thus causing the system to unbalance and producing noise, excessive vibration, erratic displacement of the washing machine (walk), and even causing the failure of an element of the system. So, to simulate the unbalance caused by the clothes, a load 15 is placed on the basket 12 and immediately afterwards, the basket is spun.

After draining the washing liquid from the tub 13 at the drying cycle, the balance ring 10 should be capable of countering the unbalancing load consequence of the settling of the objects being washed on the bottom of the basket 12. In order to dry efficiently the objects being washed, centrifugal movement at high rpm or great angular velocities is required, thus the motor of the washing machine will be energized for less time, which will produce a shorter centrifugal cycle, and in turn will save energy due basically to two concepts: first, the motor of the washing machine is energized less time; second, thanks to the higher centrifuge force applied to the objects in the washing basket, more water is removed from them and the objects are dryer. Therefore, when a drying machine is used subsequently to drying the remaining humidity on the clothes, said drying machine will require less consumption of electricity or combustible gas. However as the velocity increases the excitation frequencies might create greater amplitude of the vibration, which would cause knocking between the tub 13 and the tub 12, either making the washing machine to "walk" or causing other subsequent damages, curling or logarithmic spiral.

Figure 2:
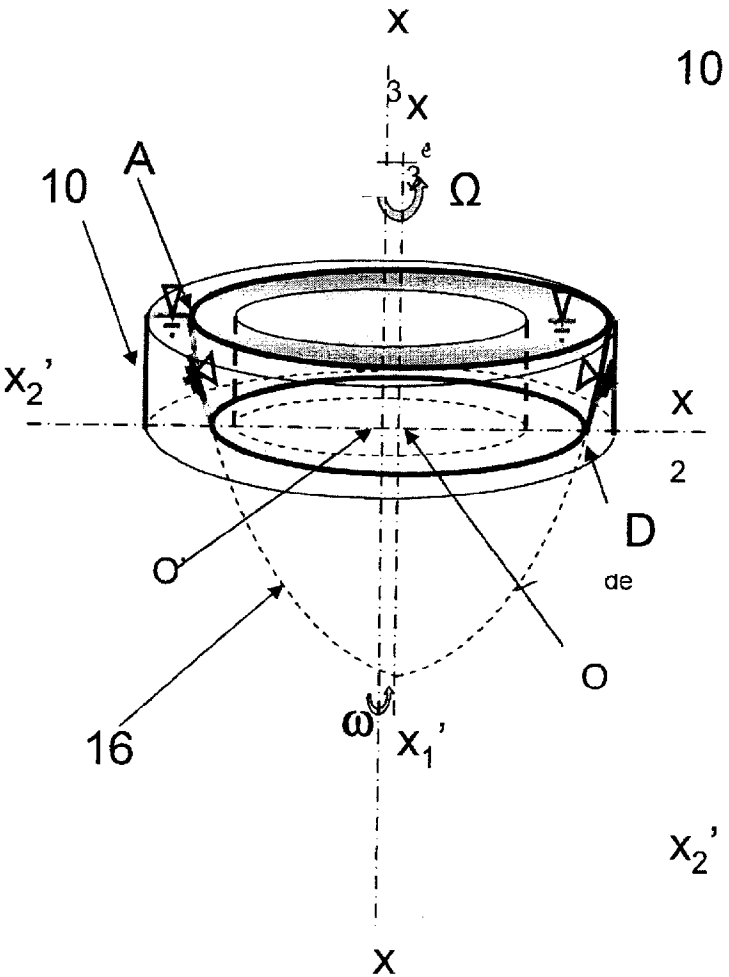
FIG. 2 Diagram of the paraboloid generated when subjecting a water cylinder to a centrifugal force.
Figure 3:
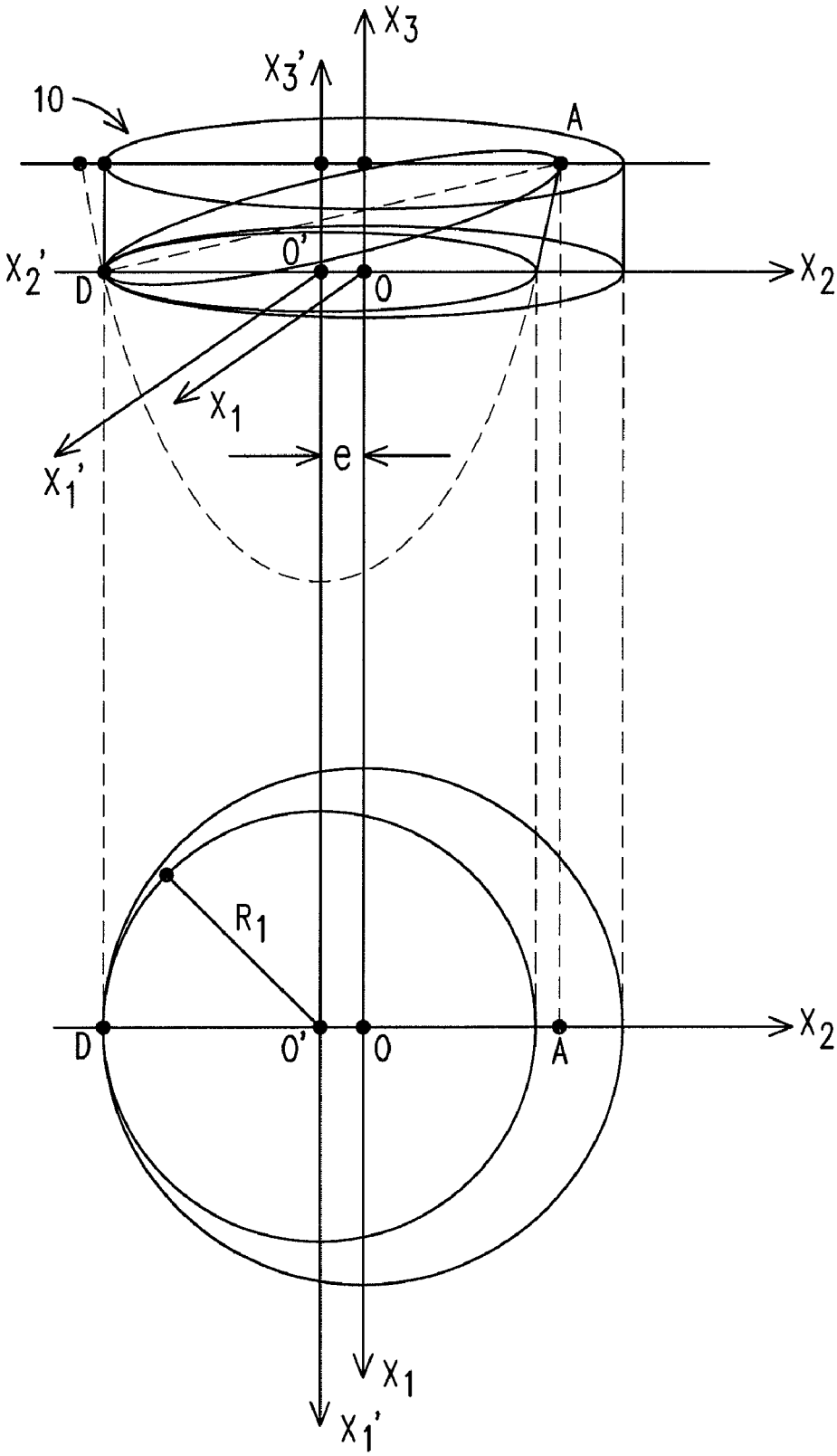
FIG. 3 Diagram of the paraboloid of a balance ring with unbalanced basket.

FIG. 2 shows the paraboloid 16 that is formed when rotating a liquid within a cylindrical container, the paraboloid 16 is formed by the surface free of said liquid, while the rest of the molecules occupy the volume between said free surface delineated by the paraboloid and the walls of the container. From this figure we learn that when a liquid is rotated, it will always try to form said paraboloid 16, even if it is encapsulated like a logarithmic or curling spiral in a square transversal section toroid, such as a balance ring 10. Please note that in a washing machine the rotational angular velocity $\omega$ matches the symmetry axis $X_1$-$X_3$ of the balance ring 10, but just as the planet Earth, the balance ring 10 along with the basket 12 has precession or orbit $\Omega$ over a $X_1'$-$X_3'$ axis parallel to the symmetry axis which orbits around the axis $\omega$, at a distance "e". Said precession has a certain correlation with the unbalancing load 15, because the greater the imbalance of the basket 12 is, there is a longer distance "e". On the other hand the FIG. 3 shows a diagram of balance ring 10 with an ideal behavior, this is, assuming that the unbalancing load 15 is placed inside the basket 12 in a vertical axis that matches the tangential point "D". Said tangential point "D" represents the point where the surface free of the liquid and the base of the chamber of the balance ring 10 coincide; on the other hand, just to 180° of this point there is the point "A" where the free surface and the top wall of the chamber coincide; as can be seen the greater volume of liquid is concentrated in the neighborhood of the point "A". Also, the mass decreases as it approaches the point "D", this mass accommodation creates a vector of similar magnitude and opposite direction from the vector created by the unbalancing load in the basket 12, therefore the forces tend to offset, thus reducing the vibrations caused by the unbalancing load 15 inside the basket 12. To study this phenomenon is necessary to have a two-coordinate system. The first corresponds to the state at rest, where the angular velocity $\omega$ is zero and matches the symmetry axis of the balance ring 10, said axis is known as $X_1$-$X_3$.

FIGS. 2 and 3 also shows that for the study of the behavior of the liquid, a hypothesis is established that there is no axial displacement over the axis $X_1$-$X_3$, because the suspension 11 that holds the basket 13 minimizes said movement combined with the lack of moving parts between the assembly of the basket 12 and tub 13 that would allow such movement. Therefore, the study is performed on the axis $X_1$-$X_2'$ or to be more specific, over the horizontal plane that contains said axis $X_1$-$X_2'$. Over this axis the geometric or ideal center of rotation "O" is located. Likewise, over the same axis we find the precession "O'" over which can be traced the inner diameter "$R_1$" of the circumference diameter of the surface free of the liquid 16 when the horizontal axis that contains the axis $X_1$-$X_2'$ is intersected. Also the distance "e" between the axis $X_1$-$X_3$ and $X_1'$-$X_3'$.

Figure 4:
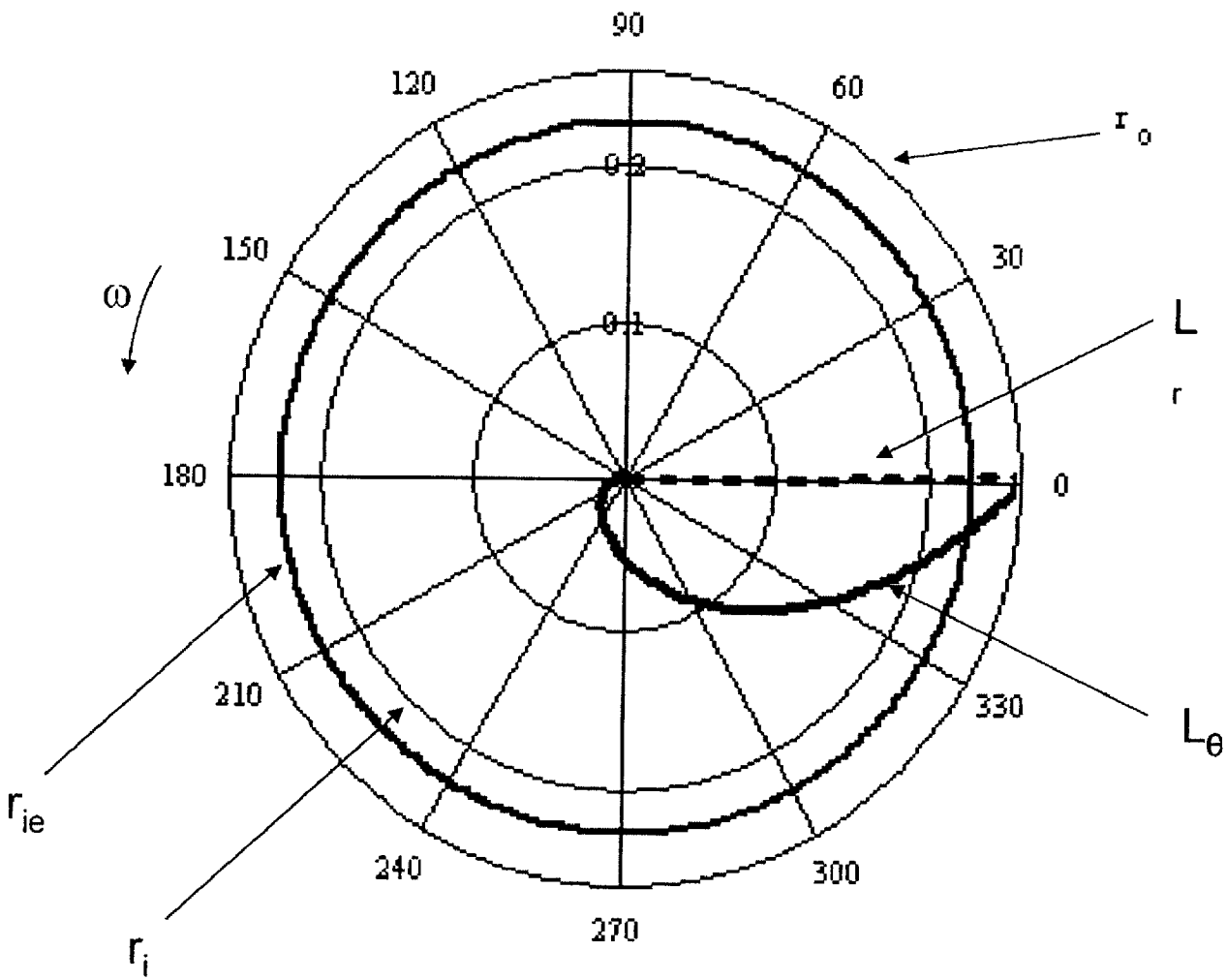
FIG. 4 Diagram of trajectory of a particle or water drop while subjected to a centrifugal force.

On the other hand, FIG. 4 shows another peculiarity that should be studied, and occurs whenever a liquid is rotated within a cylinder. The centrifugal force applied to the liquid's molecules follow a set trajectory, said trajectory is illustrated in the aforementioned figure that describes a trajectory diagram of a drop of water initially at rest, and to which container an angular acceleration is applied. So the drop will slide on the bottom of its container over the horizontal axis, describing a curling or logarithmic spiral called angular trajectory $L_\Theta$ having it reaches the inner wall with the greatest diameter of its container. This information lead us to think that the optimum trajectory of a drop of liquid within a balance ring 10 is not a straight line between its resting point and the inner wall of greatest diameter of its container, which is known as radial trajectory Lr, but a curve similar to the spiral-shaped curve trajectory $L_\Theta$ that describe the trajectory from which a drop of water reaches fastest the inner wall of greatest diameter of its container from the center or resting point. This type of trajectory should be arranged within a balance ring 10. Straight blades 21 do not give the molecules of water a proper direction in their trajectory to the inner wall of greatest diameter within the balance ring 10, and needlessly increase the time of the transition between the state at rest and the permanent state ant constant velocity. Thus a design of blades with some degree of curvature is considered desirable for the construction of a balance ring 10, where said curved blades 22 would help the molecules of water to travel faster from the resting point to the inner wall of greatest diameter of the balance ring, therefore reducing the time of the transition state and balancing the load 15 with greater velocity, and thus decreasing the magnitude of the vibration in the basket 12 causing the unbalancing load 15.

Figures 5, 6:
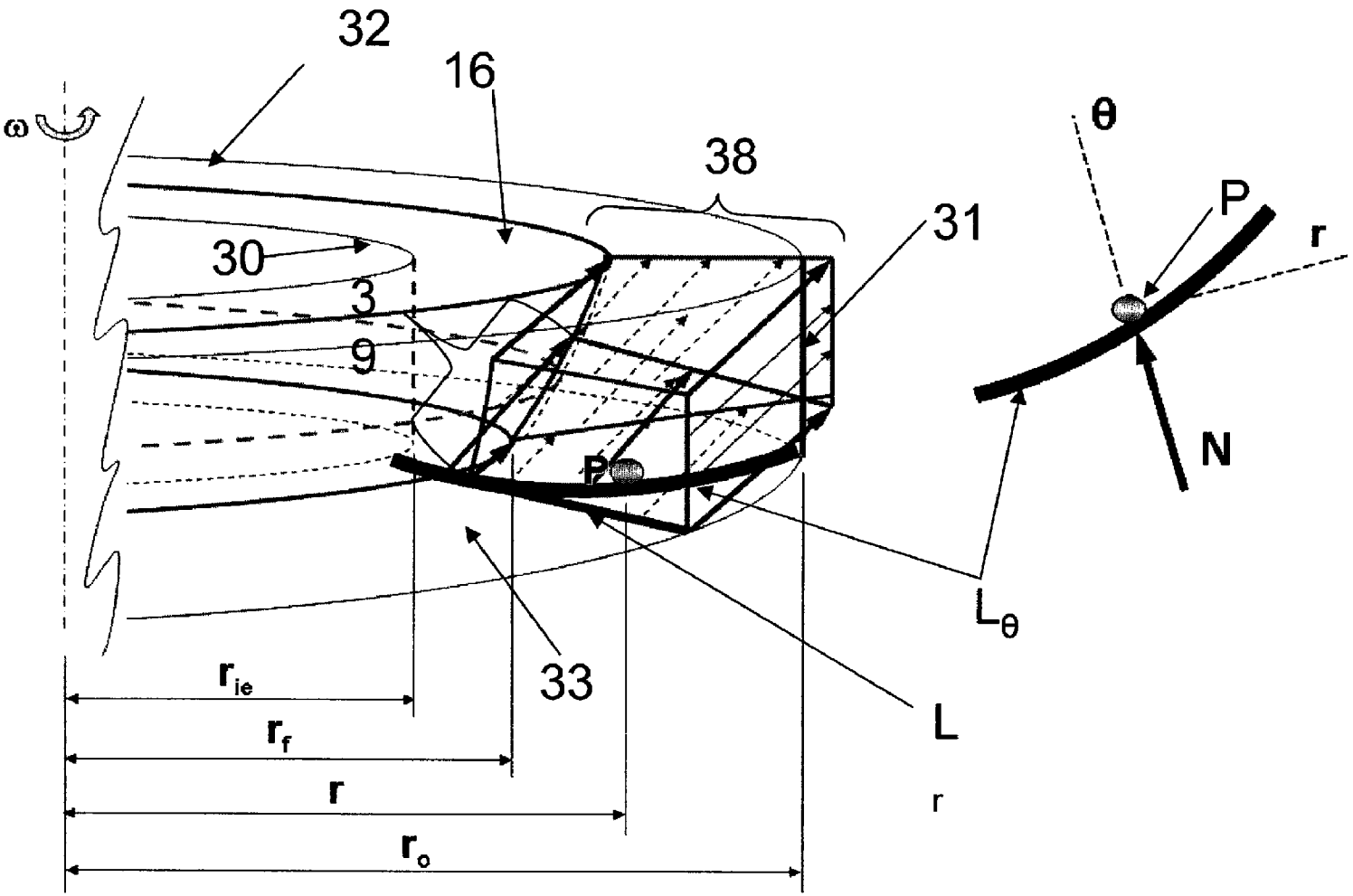
FIG. 5 Diagram of the trajectory of a particle or water drop within a balance ring that is subjected to a centrifugal force.
FIG. 6 Free body diagram of the particle or water drop subjected to a centrifugal force within a balance ring.

FIG. 5 shows the trajectory of a molecule P, to the interior of a balance ring 10. It can be glimpsed that the molecule P departs from its resting point just at the onset of the curve $L_\Theta$, just where it intersects the circumference of radius $r_{ie}$ which is formed when the surface free of liquid 16 intersects with the plane formed by the inner bottom wall 33 of the balance ring 10. The particle begins its trajectory to the inner wall of greatest diameter 31 following a curve $L_\Theta$ having at any given moment a radial coordinate "r", and an angular coordinate $\Theta$, which will define its position at all times. On the other hand, FIG. 6 allows an analysis, through a free body diagram, of the trajectory of the particle over the curve $L_\Theta$ where "N" is defined as the normal force that needs to be applied by the curved blade 22, which facilitates the trajectory of said molecule "P" along the curve $L_\Theta$ until it reaches the inner wall of greatest diameter 31. Thus one of the key benefits of the curved blade 22 in spiral $L_\Theta$ consists in minimizing the necessary time for a liquid particle P, from a resting position, to pass to the transitional state and achieve a permanent state. Likewise, as seen in FIG. 5, the profile of circumferential velocity 38 of the working liquid acquires a flat wave front, ensuring that all the liquid particles in the same radial position are displaced homogeneously, jointly and simultaneously with minimal loss of energy, unlike the non-homogeneous front 39 acquired by the working liquid when a straight blade 21 with radial trajectory $L_r$ is used, and which implies a gap in the relative movement between particles P which produces greater internal friction in the fluid, interruption efforts, and energy losses which eventually delay even more the movement of the particle P, and increase the time it needs to achieve the permanent state.

Figures 7A, 7B:
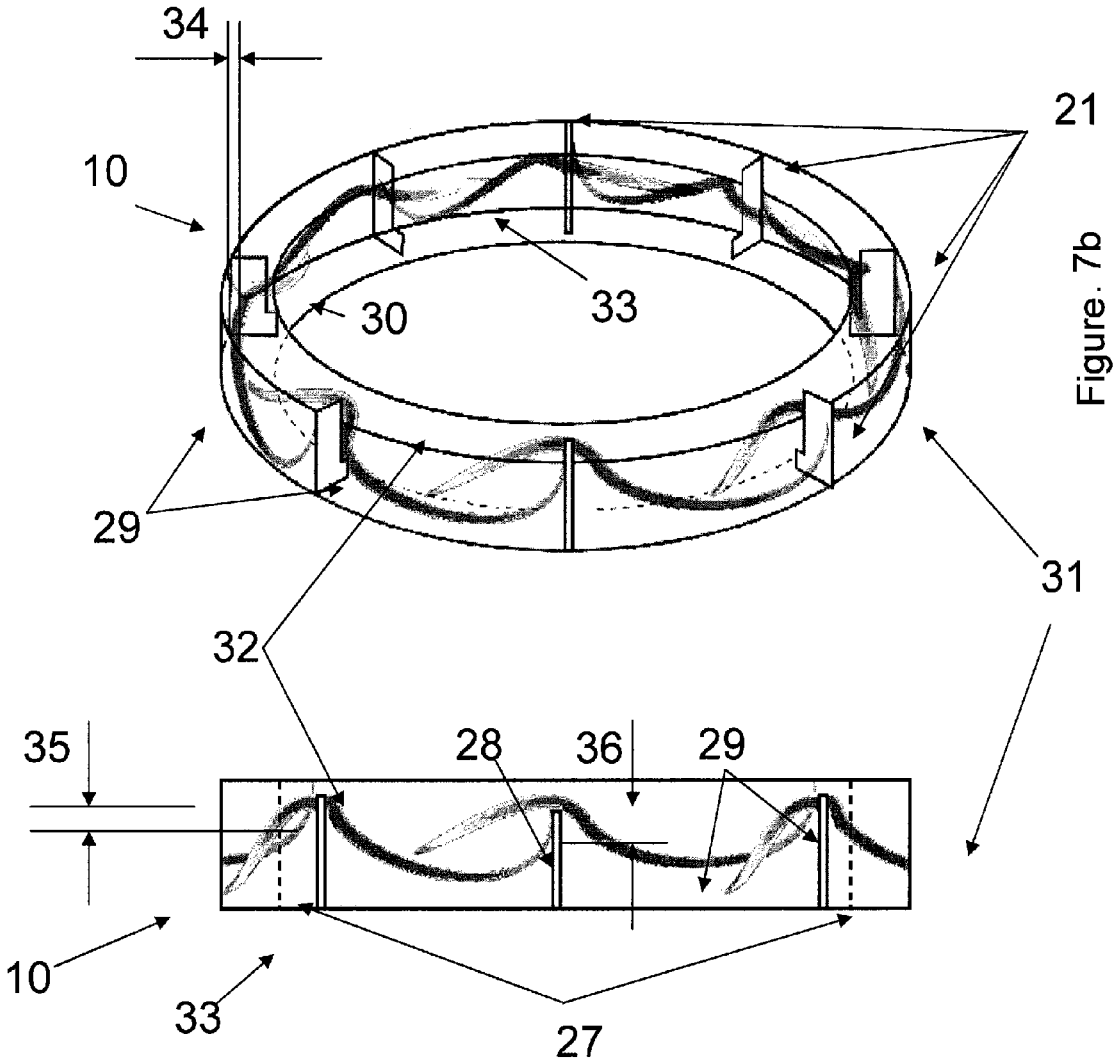
FIGS. 7*a* and 7*b* Schematic views of a balance ring with radial blades, in which the flow of water through the blades is visualized.

Other issue to consider in the design of a blade balance ring 10 is the currents 29 that must be formed inside the balance ring 10 to make the liquid flow through the chamber of the balance ring, both in the transitional state as well as the permanent state. It is characteristic of liquids to have undulated trajectories, due to the density and cohesion between molecules, hence when we drop a stone in a mirror of water it forms waves in the surface, or when the air with certain velocity drags through friction the free surface of a mirror of water, it also forms waves, such as oceanic waves. The countless natural manifestations lead us to think that the liquids tend to form undulated trajectories, but not rectilinear trajectories. To prove this, an experiment was carried out with a high velocity camera that took pictures of a transparent balance ring. This study determined the flow pattern of a liquid inside a balance ring 10 with straight blades 21. When the transitional state of the liquid previously at rest is accelerated, it shows a singular pattern, similar to the undulations of the sea. The fluid tends to rise and descend horizontally, that is, to this trajectory a vertical undulation component must be added. Thus a helicoidal three-dimensional pattern similar to a braid is produced. This pattern may be the result of the mechanical vibrations the balance ring 10 is subjected to, as well as the very nature of the liquids. To achieve a successful design for a balance ring 10, it is desirable to take in consideration this pattern of behavior of a liquid inside a balance ring 10, thus FIGS. 7*a* and 7*b* show the trajectory of the fluid 29 similar to a "braid". If said liquid's behavior is not encouraged, the liquid tends to crash between the blades, producing an opposing force to the spinning direction of the balance ring 10, which causes a constant knocking producing a deficient and delayed transitional state and an unnecessary energy consumption. Between the blades 21 and the inner wall of smallest diameter 30 there should be a opening 34 that allows the adequate flow of the liquid as this helps the vertical undulated component without ignoring the horizontal component to induce a three-dimensional helicoidal flow similar to a braid, therefore is necessary that the blades 21 have different heights, such as alternating raised blades 27 and lowered blades 28. The raised blades have a smaller opening 35 and the lowered blades have a bigger opening 36. This configuration is intended to reduce to a minimum the knocking of the fluid against the blades, and if we add a special curvature to the blades, the movement and the trajectories of the fluid particles inside a balance ring 10 will be more efficient, thus the transitional state time and the amplitude of the vibrations produced during this time will be reduced.

Due to the above enunciatively but not limitative statements, example equations for the curvature $L_\Theta$ are proposed, although any curvature similar to a curling or logarithmic spiral will describe with a substantial degree of approximation the curvature of the blades $L_\Theta$.

The theoretical formulation of the differential equation of the movement of particle P based on the free body diagram of FIGS. 5 and 6 is given by:

$$m\left(\frac{d^2}{dt^2}r - \frac{d}{dt}\theta\right) = mr\omega^2 \tag{a}$$

The solution to this equation without taking into account frictional losses is given by:

$$L_\Theta = r_{ie}\cos h(\theta) \tag{b}$$

Where $r_{ie}$ is the inner radius of the chamber of the balance ring with a completely square cross section and equivalent volume $\Theta = \omega t$ $\Theta$: angular polar coordinate in radians $\omega$: angular velocity in rad/s t: time in seconds On the other hand the radial and tangential velocity for any instant of the trajectory is given by:

$$V_r = r\omega \sin h(\theta) \tag{c}$$

$$V_\Theta = r\omega \cos h(\theta) \tag{d}$$

However, experiment adata indicate that a more appropriate equation for the trajectory of particle P in Cartesian equations may be given by:

$$L_\theta(x) = a(\cos(\theta+\phi)+\theta\sin(\theta+\phi)) \tag{e}$$

$$L_\theta(x) = a(\sin(\theta+\phi)+\theta\cos(\theta+\phi)) \tag{f}$$

Where a: constant with a preferred value of $r_{ie}$ $\phi$: phase angle in radians that defines the radial position of the onset of the curve The (e) and (f) equations are preferred in the present invention, but are not limiting to another type of curve or spiral, such as the following polar function example:

$$r = b * k^{(c\theta)} \tag{g}$$

Where b: constant with a preferred value of $r_{ie}$ and defines the onset of the trace of the spiral k: exponential base ranging from 0 to 3 and with a preferred value e or 10, which defines the curvature of the spiral e: number 2.718 c: constant ranging from 0 to 3 with a preferred value of 2.313 and defines the exponential rate of increase of the ordinate Due to convention, the blades that follow the spin direction of $\omega$ that follow a trajectory $L_\theta$ will be known as positive curved blades 21. Antagonistically, the negative curved blades 22 follow a negative trajectory of $L_\theta$, that is, the equation used to describe the trajectory $L_\theta$ is multiplied by one of its sides less one, thus the concavity of the curve is reversed and produces a mirror function of $L_\theta$; the straight blades 20 are only radial blades without a positive or negative curvature of $L_\theta$.

Figure 8:
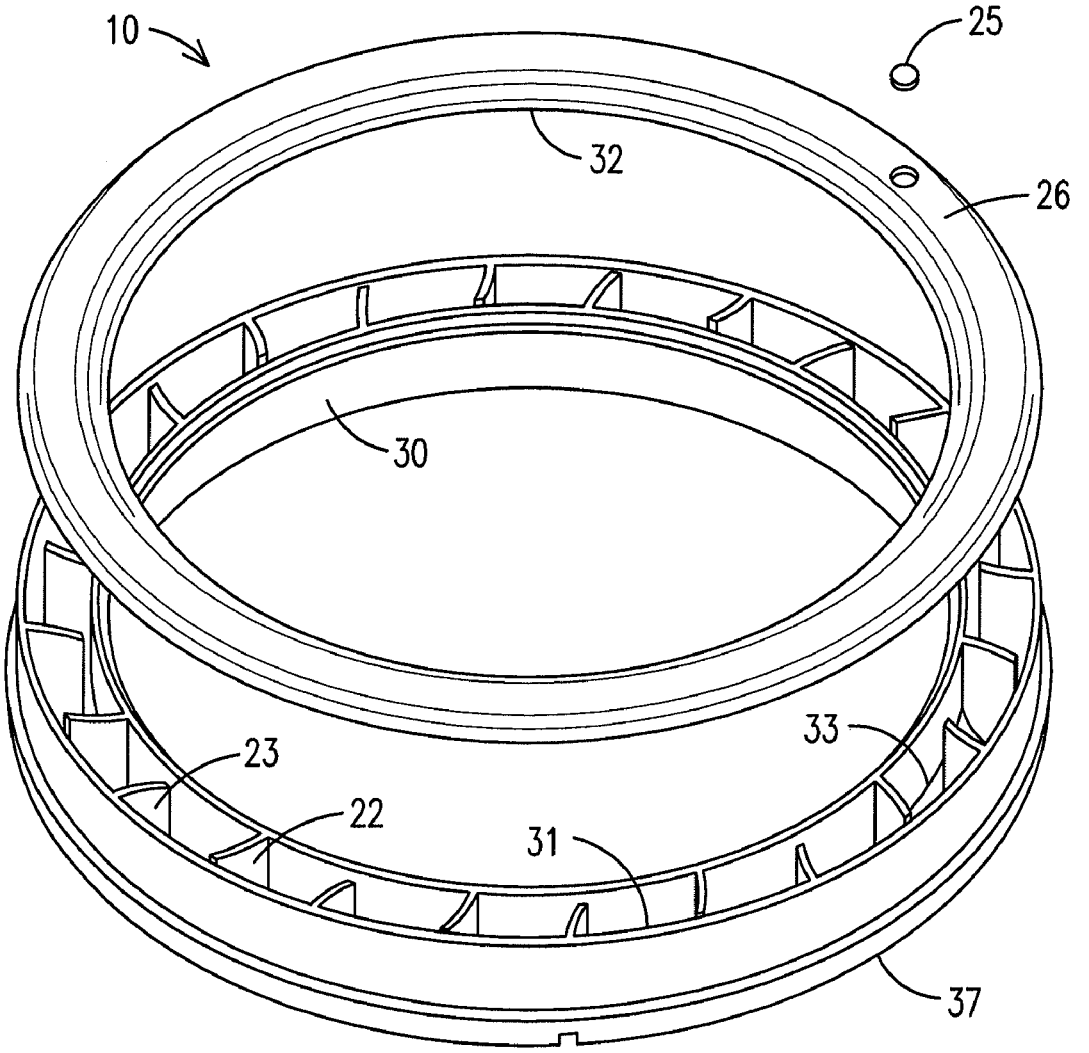
FIG. 8 Exploded isometric view of the balance ring components.

FIG. 8 is an exploded isometric view of the balance ring 10 that shows its basic elements. The base 37 houses the blades 21, 22 or 23 in all its configurations or combinations. Said base is preferably injection molded with some thermoplastic. The transversal section resembles a "U", its walls form the inner wall of smallest diameter 30, the inner wall of greatest diameter 31 as well as the bottom wall 33. On the other hand, the top inner wall 32 is formed by the casing 26, which resembles a uniform thickness ring also manufactured preferably by injection molding of a certain thermoplastic. The casing 26 is joined to the base, preferably via ultrasound, spin-welding or hotplate techniques or a similar means or with and adhesive or binder. The sealing must be done with great care because the inner cavity of the balance ring 10 will be filled with some type of working liquid, preferably calcium chloride or sodium chloride, which must remain contained. The plug 25 is inserted in the hole provided to fill the working fluid of the balance ring 10 and in effect to seal the aforementioned hole.

Figure 9:
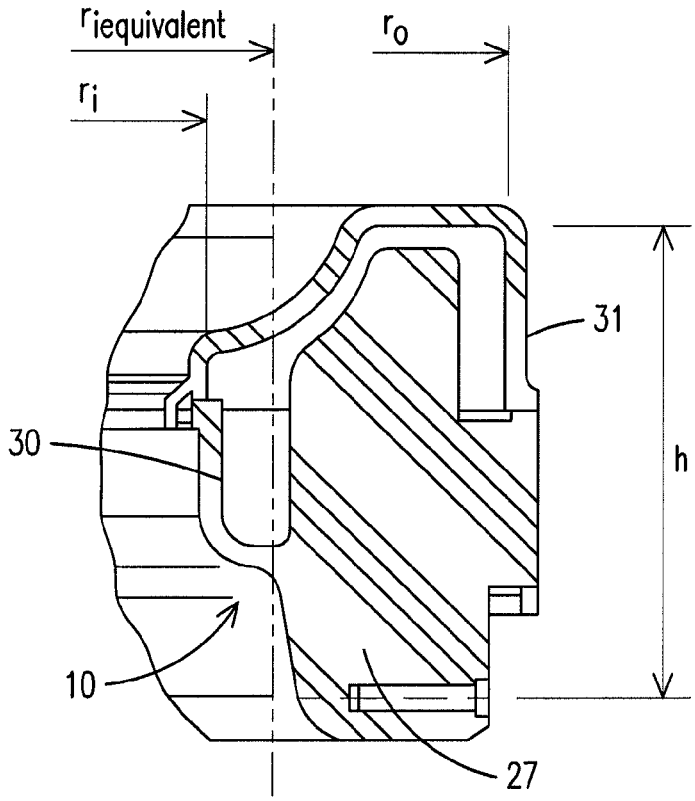
FIG. 9 PRIOR ART
FIG. 9 Cross section of the balance ring of the previous art.

FIG. 9 shows the cross section of a typical balance ring 10 already existing in the previous art. Here we notice the shape of a blade 27 within the chamber of the balance ring 10 of the present invention, which allows us to observe the different ratios to be considered for the calculations of the volume of working liquid, which varies depending on the loads to be balanced 15, the geometry of the basket 12, the capacity of the basked 12, type of suspension 11, among others, being at all times an activity exclusive to the designer. The inner radius "$r_i$" that in most cases overlaps with the radius of the inner wall of smallest diameter 30 has to be considered. Due to design requirements it is somewhat hard to construct a chamber with a fully rectangular cross section inside the balance ring 10, therefore it is necessary to estimate the inner imaginary radius, denominated "$r_{iequivalent}$" or $r_{ie}$. In FIG. 9, the external radius "$r_o$" does not have any complications. Since the balance ring 10 has to be attached by its outer wall to the inner top wall of the basket 12, the inner wall of greatest diameter 31 does not allow said outer wall of the balance ring 10 to have a complex geometry and thus limits the number of design options; therefore it is recommended that only the inner wall of greatest diameter 31 is thickened to form the outer wall of the balance ring 10. Other element to consider regarding the calculation of the volume of the working liquid is the free inner height of the chamber within the balance ring 10, which in the aforementioned Figure is represented by the letter "h". With this data, as well as the shape of the blades that will be used, the estimation and if applicable, the design of the experiments to use to determine the volume of working liquid to use, which varies from 50 to 80% of the total volume of the inner chamber of the balance ring 10, can proceed.

Figure 10:
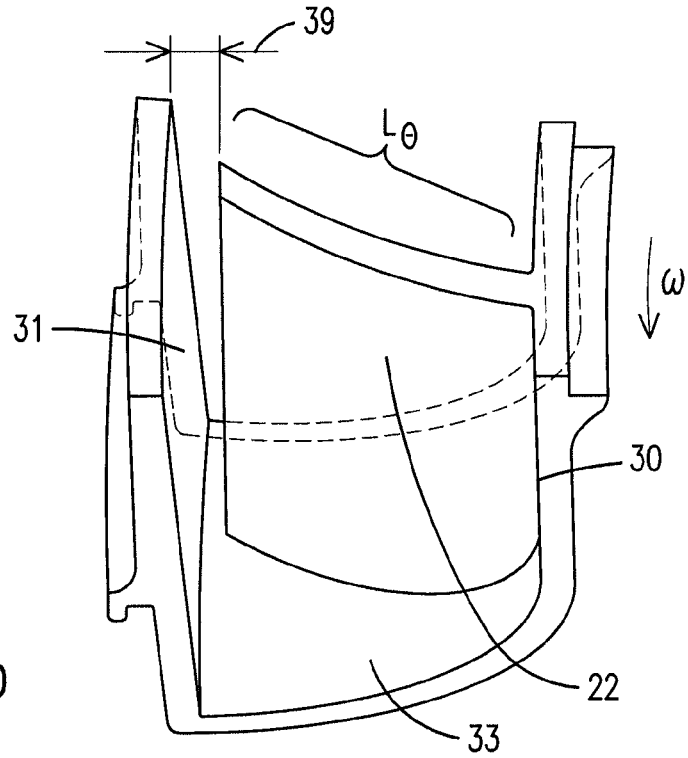
FIG. 10 Isometric ghost view of a section of the balance ring with curved blade.

FIG. 10 shows an isometric ghost view of the inner geometry of a positive curve blade 22. This denomination is taken from the spin direction of ω of the basket 12, in enunciatively form, to describe an example embodiment of the present invention, but not limitative to this peculiarity. The positive blades 22 originate at the inner wall of smallest diameter 30 and extend following the curve $L_\Theta$ to the inner wall of greatest diameter 31 leaving a vertical space 39 between the positive curve blade 22 and the inner wall of greatest diameter 31. In one example embodiment of the present invention, all the blades 21, 22 or 23 have the same height as the base of the balance ring 37, to facilitate its manufacturing; also all the blades 21, 22 or 23 at their bottom coincide with the lower inner wall 33, thus delimiting the flow of the working liquid either by the sides of said blades 21, 22 or 23 or by the top part in the case of lowered blades 28.

Figure 11:
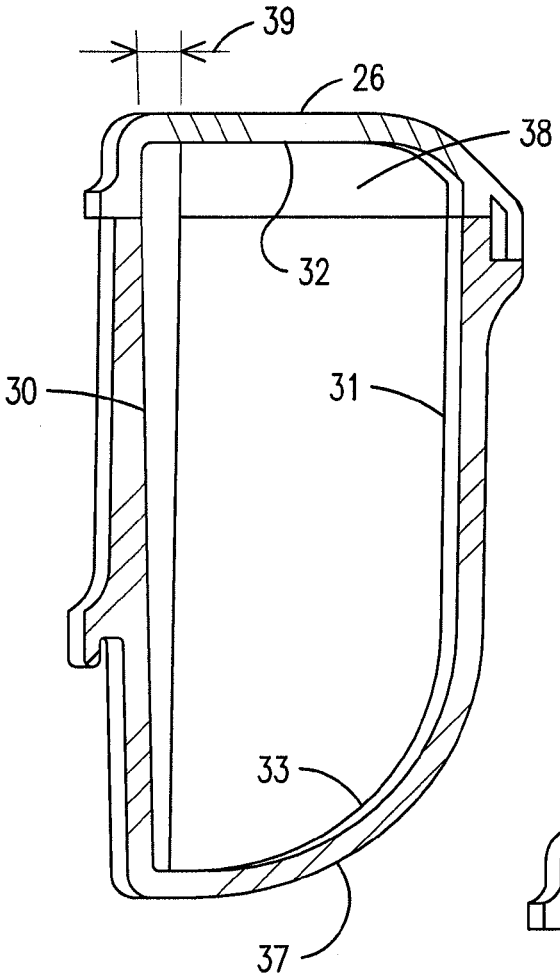
FIG. 11 Cross section of the balance ring showing a raised blade.
Figure 12:
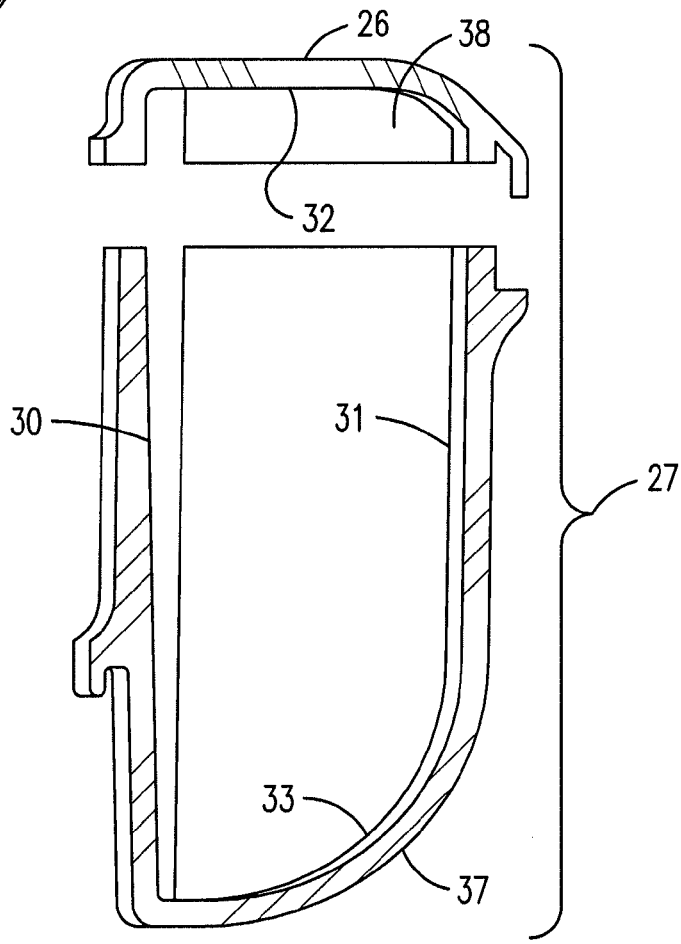
FIG. 12 Exploded cross section of the balance ring showing a lowered blade with its complement of blade.

FIGS. 11 and 12 show a cross section of the balance ring 10, where the conformation of a raised blade 27 can be seen, and which obstructs the flow of the liquid between the bottom inner wall 33 to the inner top wall 32, it originates from the inner wall of smallest diameter 31 and follows the curve $L_\Theta$ leaving a vertical space 39 between the raised blade 27 and the inner wall of greatest diameter 30. Said vertical space 39 allows the vertical flow of the undulated vertical current of the working liquid to the interior of the inner chamber of the balance ring 10. In one example embodiment of the invention, the raised blade 27 is shaped by a lowered blade 28 that may have the shape of blades 21, 22 or 23, whose height is limited by the ease of manufacturing to the height of the base 37 of the balance ring 10. Its height is complemented with a protuberance formed by the bottom side of the casing 26. Said protuberance is known as a complement of blade 38 and its transversal section may take the shape of blades 21, 22 or 23, so the top side of the blade 28 connects with the bottom side of the blade complement 38, forming a barrier with the floor in the bottom inner wall 33 and the roof in the top inner wall 32. In an alternative embodiment, the blade complement 38 may be shorter, to allow the passage of the working liquid through the top part of the blade 28 to allow the working liquid to flow in its horizontal component. The same effect or a very similar one may be obtained by constructing blades 28 of at least two diverse sizes, or by constructing the blade complement 38 in at least two diverse sizes; or by removing them completely from the bottom side of the casing 26 to make room for the extended blades 28, or by a combination of the aforementioned options, which shall be considered entirely incorporated herein as reference, that is, as one example embodiment of the invention. The blades 27 substantially block the horizontal component of the flow of the working liquid, understanding that in an alternative embodiment the raised blades 27 do allow the flow of working liquid to have a horizontal component by having an opening 35 between the raised blade and the top inner wall 32, or between the blade complement 38.

Figure 13:
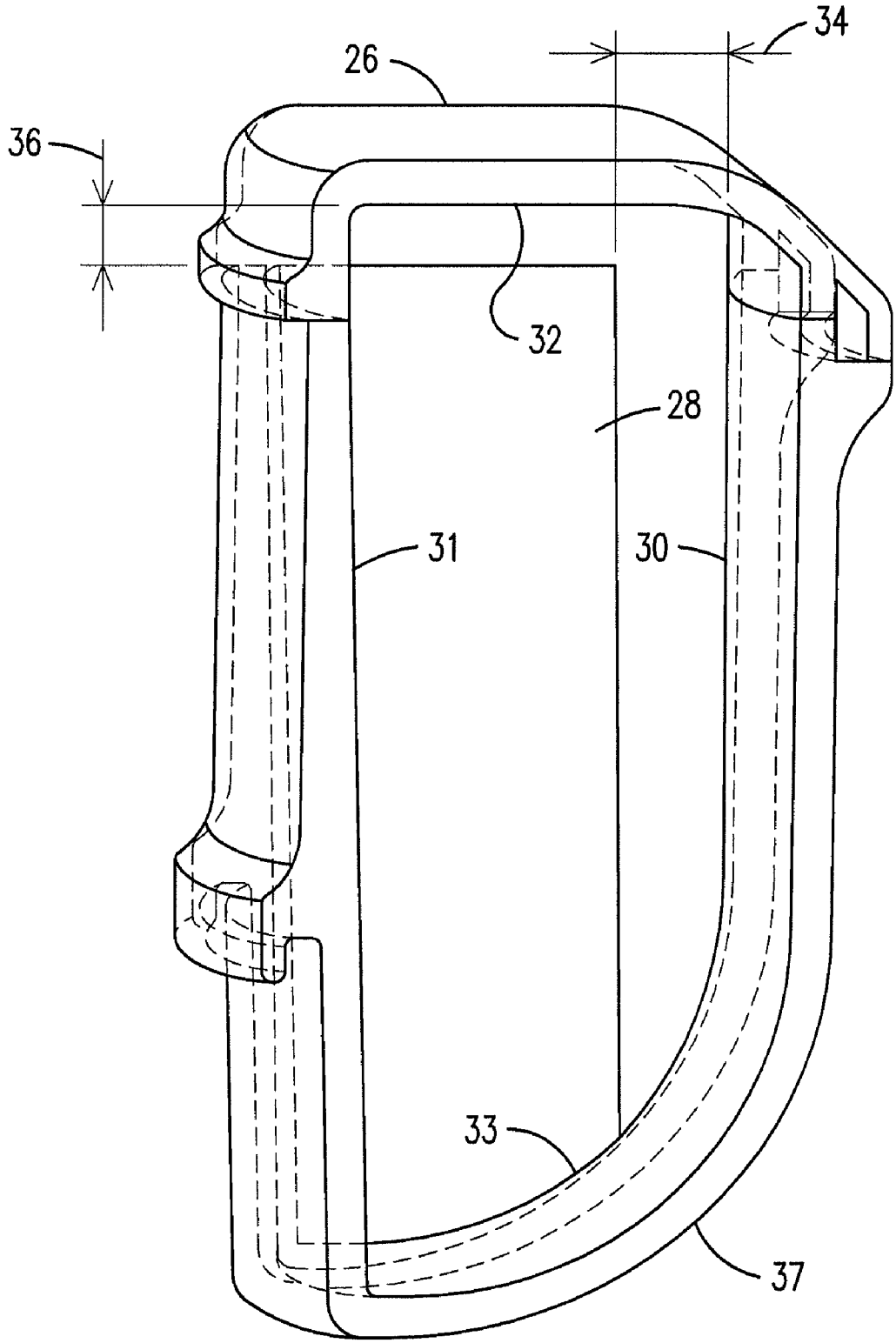
FIG. 13 Ghost view of a section of the balance ring showing a lowered blade.
Figure 14:
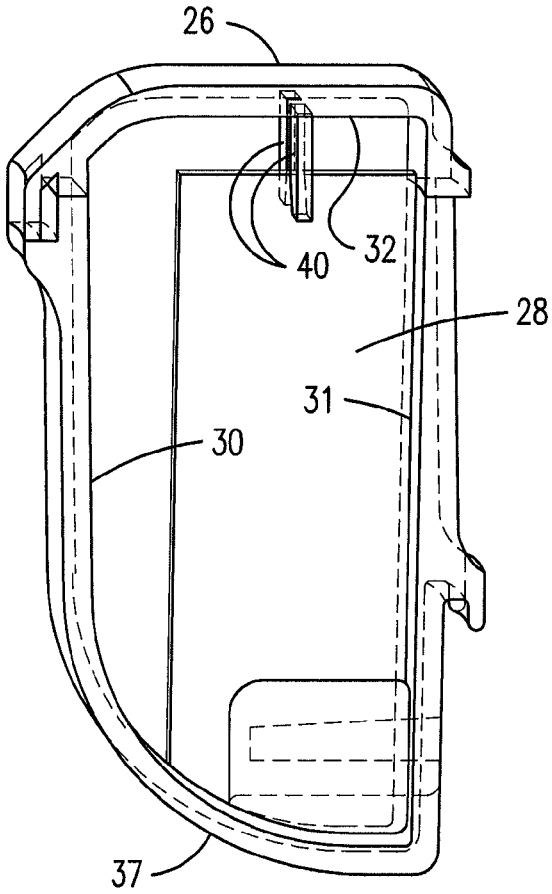
FIG. 14 Ghost view of a section of the balance ring showing a lowered blade and a finder.
Figure 15:
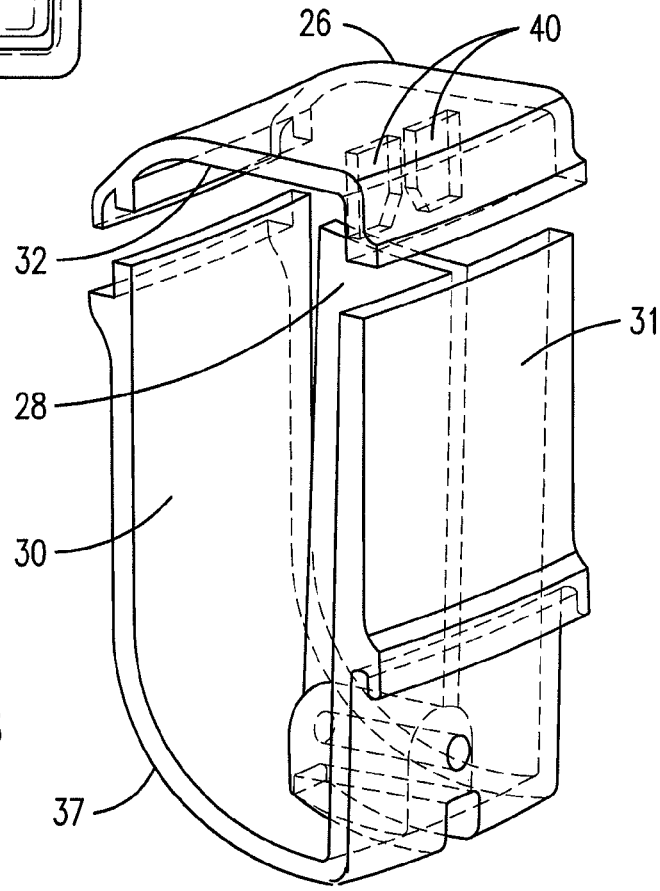
FIG. 15 Exploded ghost view of a section of the balance ring showing a lowered blade and a finder.

FIG. 13 shows a ghost view section of the balance ring 10, which allows us to assess the conformation of a blade 28. It is evident that said blade 28 has the same height that the base 37 of the balance ring 10, this Figure shows a blade that originates from the inner wall of greatest diameter 31 and follows the shape of ~$L_\Theta$ to the inner wall of smallest diameter 30 without touching it. Between the vertical side of said blade 28 and the inner wall of smallest diameter 31 there is a space 34; the blade 28 by virtue of having the same height as the base 37 of the balance ring 10, produces a opening 36 between the top side of the blade 28 and the inner top side 32, thus the openings 34 and 32 allow the flow of the working liquid to have horizontal and vertical components respectively.

Figure 16:
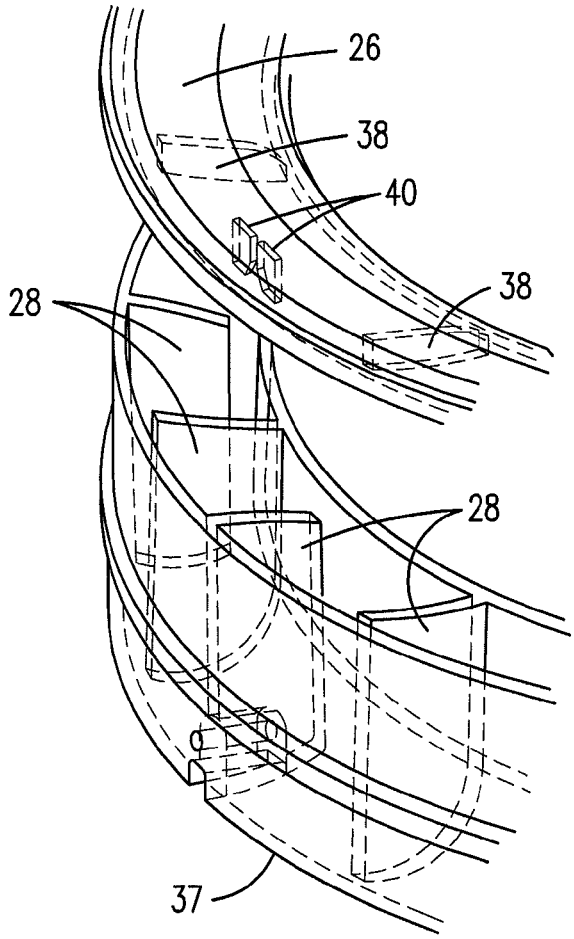
FIG. 16 Isometric exploded ghost view of a section of the balance ring.
Figure 17:
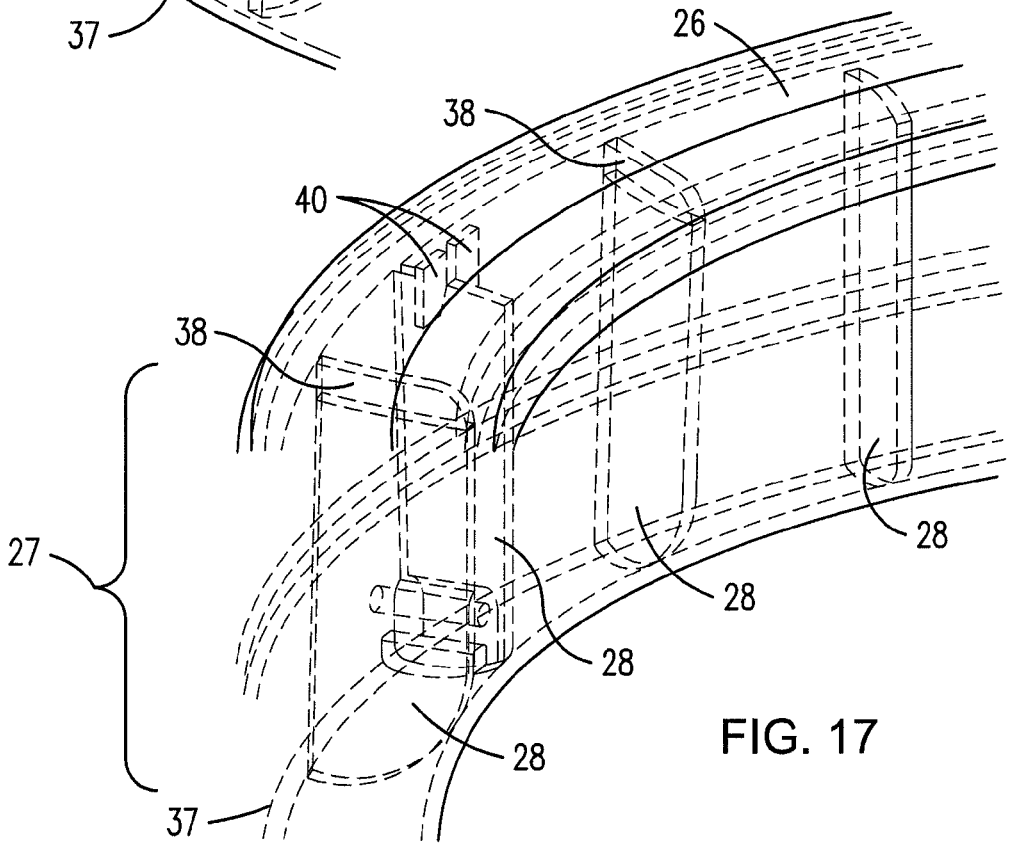
FIG. 17 Isometric ghost view of section of the balance ring.

FIGS. 14, 15, 16 and 17 allow us to understand the assembly of the base 37 with the casing 26. To facilitate the assembly of the base 37 with the casing 26, a finder 40 was devised that, in a descriptive but not limitative manner in order to describe better the optimum way to execute the invention, consists of a pair of embossed walls 40 in the inner bottom wall 32 which can be seen in FIGS. 14 and 15. Said embossed walls or finder 40 consists of a bay with a conduit that forms a "Y", which appears inverted in the aforementioned figures. Because the bay is ample, it allows the localization and guidance of the top part of blade 28. This permits that the casing 26 always keeps a correct position with the base 37 at the time of assembly, which is shown in FIGS. 16 and 17, thus avoiding localization mistakes that may cause a malfunction of the balance ring 10.

Figure 18:
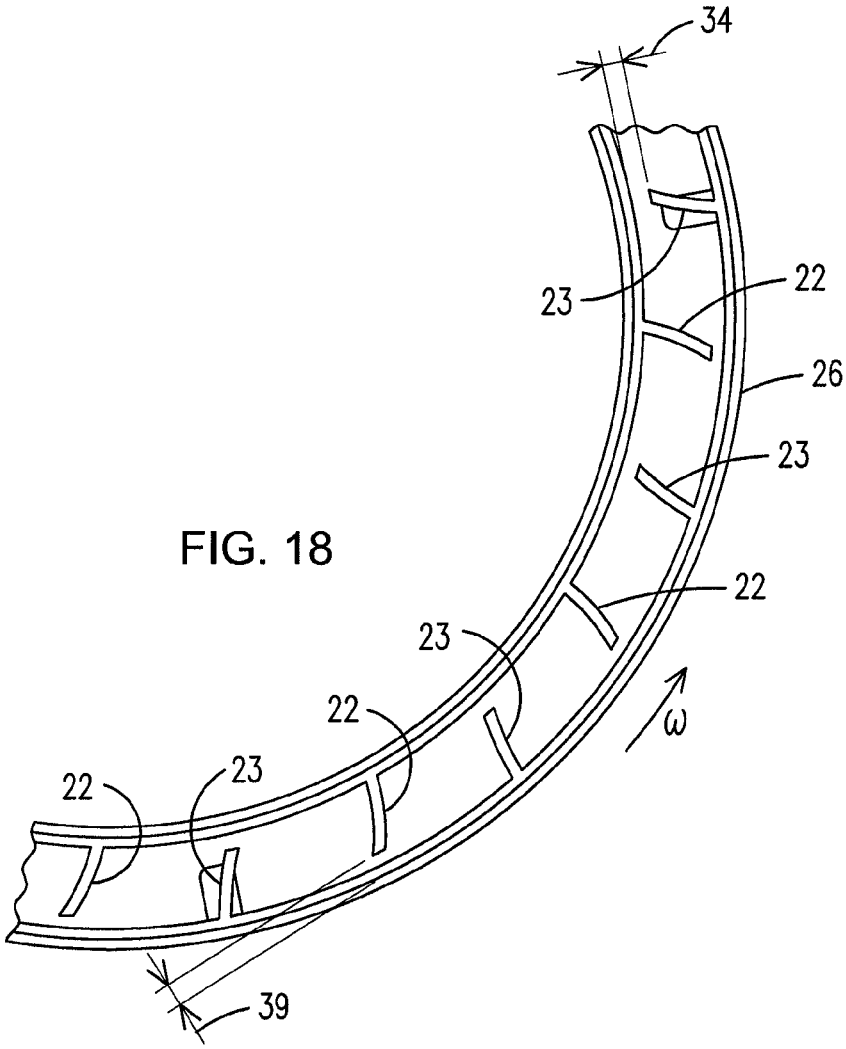
FIG. 18 Top view of a segment of the base of a balance ring showing positive and negative curved blades.
Figure 19:
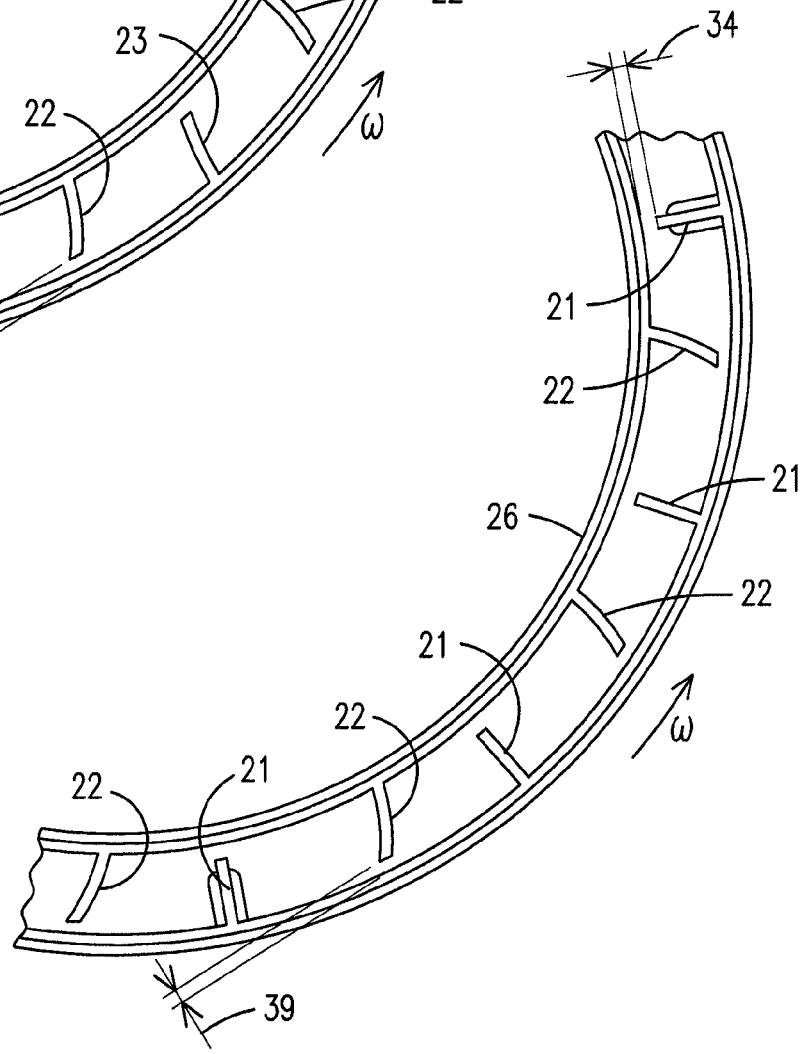
FIG. 19 Top view of a segment of the base of the balance ring showing positive and straight curved blades.

FIGS. 18 and 19 are useful to identify the different types of blades 21, 22, 23 since the base 26 may house different types of blades. The previous art describes arrangements of radial straight blades. As discussed in the background chapter as well as the theoretical formulation, these arrangements are not desirable. Thus FIG. 18 shows an example embodiment of the invention consisting of an arrangement of positive curved blades 22 with negative curved blades 23, with their respective clearances 34 and 39. FIG. 19 shows an alternative embodiment of the invention, with an arrangement of positive curved blades 22 with straight blades 21 because of the spinning direction of the basket 12. It is evident for one skilled in the art that if the basket 12 spins on the opposite direction, the negative curved blades 23 might achieve a better result than the positive curved blades 22.

Figure 20:
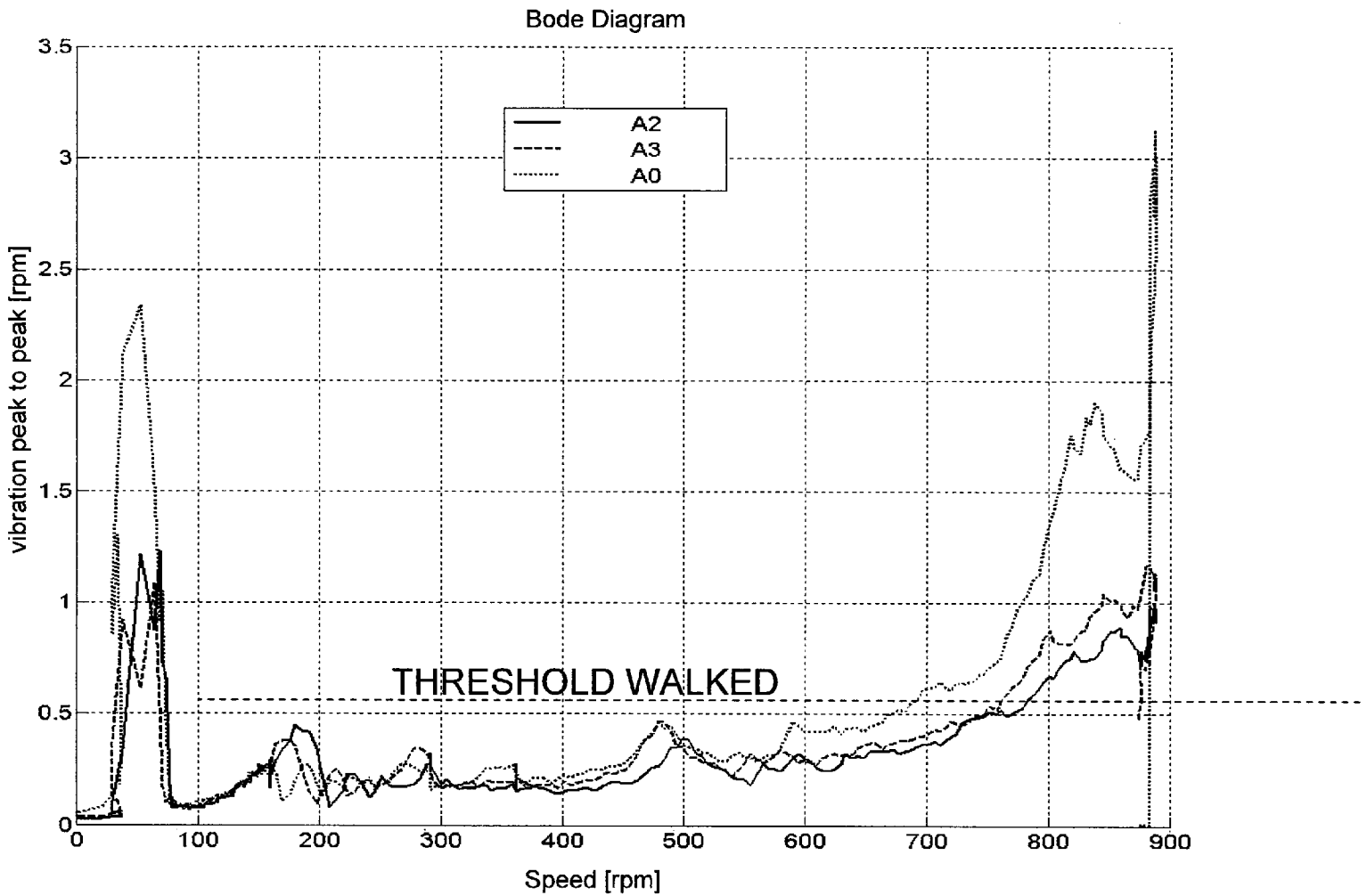
FIG. 20 Bode diagram for the front side of the washing machine.

FIG. 20 shows a Bode diagram that charts the angular velocity of the basket 12 measured in revolutions per minute (rpm) versus the vibration peak to peak as measured in the front side of the housing of the washing machine. For this graphic, the threshold for detecting walking is close to 1 mm, that is, for a given angular velocity, if the peak-to-peak vibration is over 1 mm, the washing machine will tend to move randomly in some direction. This chart also shows the vibrations obtained while using different arrangements of the balance ring 10, using the same sub-washing machine 17 with the same unbalancing load 15. Several balance rings 10 with different internal configurations were used. For the curve "A0" represented by the dotted line ····· they represent the baseline, that is, a conventional balance ring 10 which employs straight radial blades 21 was used. Notice that below 100 rpm there is a peak greater than 2 mm, afterwards above 600 rpm the vibration separates from the other curves, this indicates that the design of a conventional balance ring does not withstand high rpm. As the chart shows, above 800 rpm, there is a difference of approximately 1 mm from the rest of the curves, also when reaching close to 900 rpm there is a peak greater than 3 mm, thus demonstrating the inability of this type of balance rings 10 to balance loads 15 at velocities faster than 600 rpm. On the other hand, the curve "A2" represented by the chopped line ------has an arrangement of twelve positive curved blades 22 alternated with twelve straight blades 21. This arrangement lowers noticeably the vibration when compared to the baseline "A0". This demonstrates that the molecules "P", thanks to the curvature of the blades 22, move faster from a resting state to the inner wall of greatest diameter 31, thus it can be deduced that the transitional state is shorter (taking into account the constant acceleration), and the vibrations are of less amplitude (close to 1 mm) so an acceptable behavior is achieved between 600 and 850 rpm. This also appears in the chart of the curve "A3" on FIG. 20, represented by a continuous line —— which describes a behavior similar to the curve "A2", and corresponds to a second preferred configuration of balance ring with twelve positive curve blades 22 and 12 straight radial blades 21.

Figure 21:
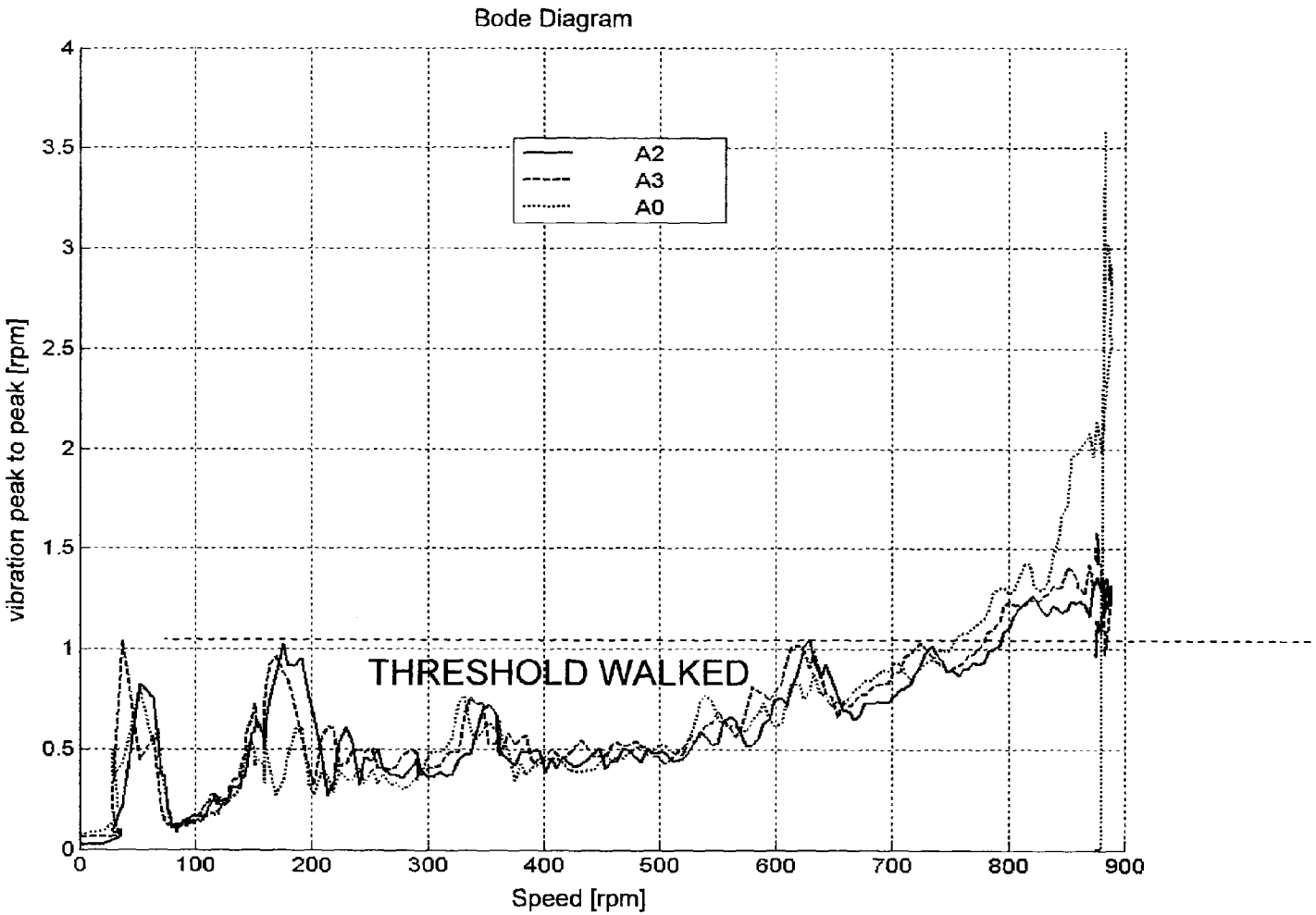
FIG. 21 Bode diagram for the lateral left side of the washing machine.

FIG. 21 shows another Bode diagram for the left lateral side of the washing machine. For this measurement the walking threshold is close to 1.4 mm of vibration peak to peak. As the present diagram shows, the three curves "A0", "A2" and "A3" have a similar behavior from 0 to 720 rpm. Above this last angular velocity, "A0" begins to be greater than "A2" and "A3", and increases off to 800 rpm, with a peak greater than 3.5 mm close to 900 rpm, that is almost 2 mm more than "A2" or "A3". Also from an analysis of the aforementioned Bode diagram, it can me inferred that the conventional balance rings 10 of straight radial blades 21 are not suitable for high rpm, because as the rpm increased, their balancing ability is seriously degraded, which is not the case with the configurations proposed herein.

Please note that the embodiments described herein shall not be interpreted in a limitative way since they merely illustrate an example way to execute the aforementioned invention, and several modifications, and further variations may be envisioned by an expert with average knowledge in this particular technique, which shall not be considered outside the scope of protection of the following claims.

The invention claimed is:

1. A washing machine comprising a concentric rotation tub that houses at least one object being cleansed using a working fluid, said tub mechanically coupled to a motor and topped by a balance ring, said balance ring comprising:

a base;

a casing coupled to the base to define a chamber;

a series of curved blades in the chamber;

a vertical clearance between the blades and an inner wall of the chamber, the vertical clearance arranged to allow a flow of the working liquid to have a vertical component;

a series of raised blades; and a series of lowered blades that alternate with the raised blades, wherein the curved blades have an angularly-extending surface which defines an angular trajectory within the chamber, the angular trajectory arranged to extend outside a radial trajectory, said angularly-extending surface configured to reduce a period of time needed for particles of working liquid to be displaced from a resting point to the inner wall of the chamber as the ring rotates.

2. The washing machine of claim 1, wherein the angular trajectory $L_\Theta$ of said curved blades is defined by the following equation:

$$L_\Theta = r_{ie} \cos h(\Theta)$$

where, $r_{ie}$: represents an inner radius of the chamber, $$\Theta = \omega t,$$

ω: represents angular velocity, and t: represents time.

3. The washing machine of claim 2, wherein the angular trajectory defined by said equation for the curved blades comprises a positive trajectory regarding a rotation direction.

4. The washing machine of claim 2, wherein, upon a reversal of the angular trajectory defined by said equation or an arithmetic multiplication by −1, the angular trajectory for the curved blades comprises a negative trajectory regarding a rotation direction.

5. The washing machine of claim 1 wherein the raised blades define a clearance that allows the flow of working liquid to have a horizontal component.

6. The washing machine of 1, wherein the raised blades and the lowered blades have an opening between a top of a respective raised blade and a corresponding lowered blade and casing.

7. The washing machine of claim 6, wherein the opening size of the raised blade is less than the opening size of the lowered blade.

8. The washing machine of claim 1, wherein a bottom of the curved blades coincide with a lower inner wall of the chamber, to delimit a flow of liquid by a side of the curved blades or by a top part of the lowered blades.

9. The washing machine of claim 1, wherein the base is joined to the casing with an ultrasound, spin-welding or hot-plate technique.

10. The washing machine of claim 1, wherein the raised blade includes:

a bottom side which is configured to form a barrier with a floor of a bottom inner wall of the chamber; and a top side which is configured to form a barrier with a roof of a top inner wall of the chamber.

11. The washing machine of claim 1, wherein each respective curved blade in the chamber encompasses at least a majority of a cross-sectional area of the chamber.

12. The washing machine of claim 1, wherein the series of curved blades comprises a series of positive curved blades and further comprises a series of negative curved blades that alternate with the positive curved blades.

13. The washing machine pf claim 1, further comprising a series of straight blades that alternate with the curved blades.

* * * * *